US012195985B1

(12) United States Patent
Figueredo

(10) Patent No.: US 12,195,985 B1
(45) Date of Patent: Jan. 14, 2025

(54) SAFETY WINDOW COVER FOR WINDOW INSTALLATION

(71) Applicant: Abraham Figueredo, Miami, FL (US)

(72) Inventor: Abraham Figueredo, Miami, FL (US)

( * ) Notice: Subject to any disclaimer, the term of this patent is extended or adjusted under 35 U.S.C. 154(b) by 0 days.

(21) Appl. No.: 18/777,087

(22) Filed: Jul. 18, 2024

(51) Int. Cl.
*E04G 21/32* (2006.01)

(52) U.S. Cl.
CPC ..... *E04G 21/32* (2013.01)

(58) Field of Classification Search
CPC ..... E04G 21/32; E04G 21/24; E04G 21/241; E04G 21/247; E04G 3/18; Y10S 52/01; Y10S 52/12
See application file for complete search history.

(56) References Cited

U.S. PATENT DOCUMENTS 2,195,361 A * 3/1940 Davis ..... E06B 7/26 49/61
4,272,922 A * 6/1981 Prager ..... E06B 9/02 49/55
4,947,616 A * 8/1990 Sorton ..... E04B 1/2612 33/645
5,354,377 A * 10/1994 Jeffrey, Jr. ..... E04G 21/241 118/504
5,383,320 A * 1/1995 Sorton ..... E04B 1/2612 33/645
5,454,415 A * 10/1995 Bolling ..... E06B 9/02 49/55
5,457,922 A * 10/1995 Fara ..... E04G 21/32 52/745.15
5,471,760 A * 12/1995 Farris ..... A47G 1/205 33/613
5,494,519 A * 2/1996 Jeffrey, Jr. ..... E04G 21/30 118/504
5,603,190 A * 2/1997 Sanford ..... E06B 5/003 52/476
5,685,112 A * 11/1997 Fara ..... E04G 21/32 52/745.15
6,371,422 B1 * 4/2002 St. Martin ..... E06B 9/02 410/151
6,474,035 B1 * 11/2002 Fara ..... E04G 21/241 52/DIG. 1
7,748,168 B2 * 7/2010 Ferrara ..... E06B 9/04 49/55
10,352,085 B1 * 7/2019 Shaoul ..... E05F 15/665
(Continued)

FOREIGN PATENT DOCUMENTS

GB 2606434 A * 11/2022 ..... E04G 21/241
WO WO-03093609 A1 * 11/2003 ..... E04G 21/3214
WO WO-2022195259 A2 * 9/2022 ..... E04G 21/241

*Primary Examiner* — Babajide A Demuren
(74) *Attorney, Agent, or Firm* — Ruben Alcoba, ESQ

(57) ABSTRACT

The present invention is a safety window cover for installing windows with sashes onto window openings. The safety window cover comprises a rectangular panel that defines a linear slit running parallel to the top side of the rectangular panel. A pressure pivot mechanism is mounted onto the linear slit. The pressure pivot mechanism is designed to slide along the linear slit. And, a lever is attached to the pressure pivot mechanism. The lever is designed to lock onto a window frame when the window is open, securing the rectangular panel outside the window frame during the installation process of the window frame onto a window opening.

7 Claims, 5 Drawing Sheets

(56) References Cited

U.S. PATENT DOCUMENTS

| | | | | |
|---|---|---|---|---|
| 2002/0017065 | A1* | 2/2002 | Clewis | E06B 9/02 52/203 |
| 2003/0145557 | A1* | 8/2003 | Corr | B25B 9/00 52/749.1 |
| 2011/0308747 | A1* | 12/2011 | Starzomski | E04G 21/241 160/368.1 |
| 2013/0048586 | A1* | 2/2013 | Pixler | E06B 7/28 211/85 |

* cited by examiner

SAFETY WINDOW COVER FOR WINDOW INSTALLATION

BACKGROUND

The present invention is directed to a safety window cover that is used to install windows that have sashes on window openings.

Installing hurricane windows is a crucial step in safeguarding homes and buildings against the devastating effects of severe weather conditions. Hurricane windows are designed to withstand high winds, flying debris, and heavy rainfall, providing enhanced protection for the interior of structures during storms. However, the installation process of these windows, particularly those with window sashes, presents significant challenges for installers, especially when performed in adverse weather conditions.

One of the primary issues faced by window installers is exposure to the elements, especially rain. Prefabricated windows with window sashes are often installed from the exterior of the building, requiring installers to work outside. During rainy weather, this exposes them to constant wet conditions, making the installation process uncomfortable and potentially hazardous. Wet conditions can lead to reduced visibility, slippery surfaces, and increased risk of accidents, all of which compromise the safety and efficiency of the installation process. Yet, normally the windows are secured to the window opening from the interior of the building wherein the window is installed. Installation requires specialty high powered drills and long drill bits and screws.

Moreover, working in wet conditions can also affect the quality of the installation. Water can interfere with sealants and adhesives used in the installation process, potentially leading to improper sealing and leaks. This compromises the integrity and effectiveness of the hurricane windows, reducing their ability to protect the building during severe weather.

The need for a device that can shield installers from rain while installing prefabricated windows with sashes is evident. Such a device would not only improve the safety and comfort of the installers but also ensure the quality and effectiveness of the hurricane window installations. The present invention addresses this need by providing a safety window cover that can be placed on the outside of the window during the installation process, effectively protecting the installers, who are on the inside of a building structure, from rain and other adverse weather conditions.

The present invention is designed to be placed on the outer side of a window opening after the window frame has been mounted from inside the building structure. The installer positions the rectangular panel of the safety window cover through the window frame opening where the window frame is installed. The rectangular panel rests on the window opening and is secured onto the window frame using a pressure lever located on the inside of the rectangular panel. The pressure lever locks onto the inside of the window frame, providing a secure and stable shield against rain and other adverse conditions. The safety window cover of the present invention represents a significant advancement in window installation, particularly for hurricane windows, enhancing both the safety of installers and the performance of the windows.

SUMMARY

The objective of the present invention is to provide a safety window cover that facilitates the installation of windows with sashes on window openings, particularly during adverse weather conditions. The safety window cover is designed to protect window installers from rain and improve the overall safety and efficiency of the installation process.

The present invention is a safety window cover for installing windows with sashes onto window openings.

The safety window cover comprises a rectangular panel that defines a linear slit running parallel to the top side of the rectangular panel. A pressure pivot mechanism is mounted onto the linear slit. The pressure pivot mechanism is designed to slide along the linear slit. And, a lever is attached to the pressure pivot mechanism. The lever is designed to lock onto a window frame when the window is open, securing the rectangular panel outside the window frame during the installation process of the window frame onto a window opening.

The present invention provides a practical solution for window installers, for it protects them from rain and other adverse weather conditions during window installation. The invention also ensures a secure and efficient installation process for windows that have sashes. The adjustable pressure pivot mechanism and locking lever of the present invention enhance the usability and stability of the rectangular panel, making it a valuable tool for improving safety and installation quality in the field of window installation.

BRIEF DESCRIPTION OF THE DRAWINGS

These and other features, aspects, and advantages of the present invention will become better understood with regards to the following description, appended claims, and drawings where:

DESCRIPTION

Figure 1:
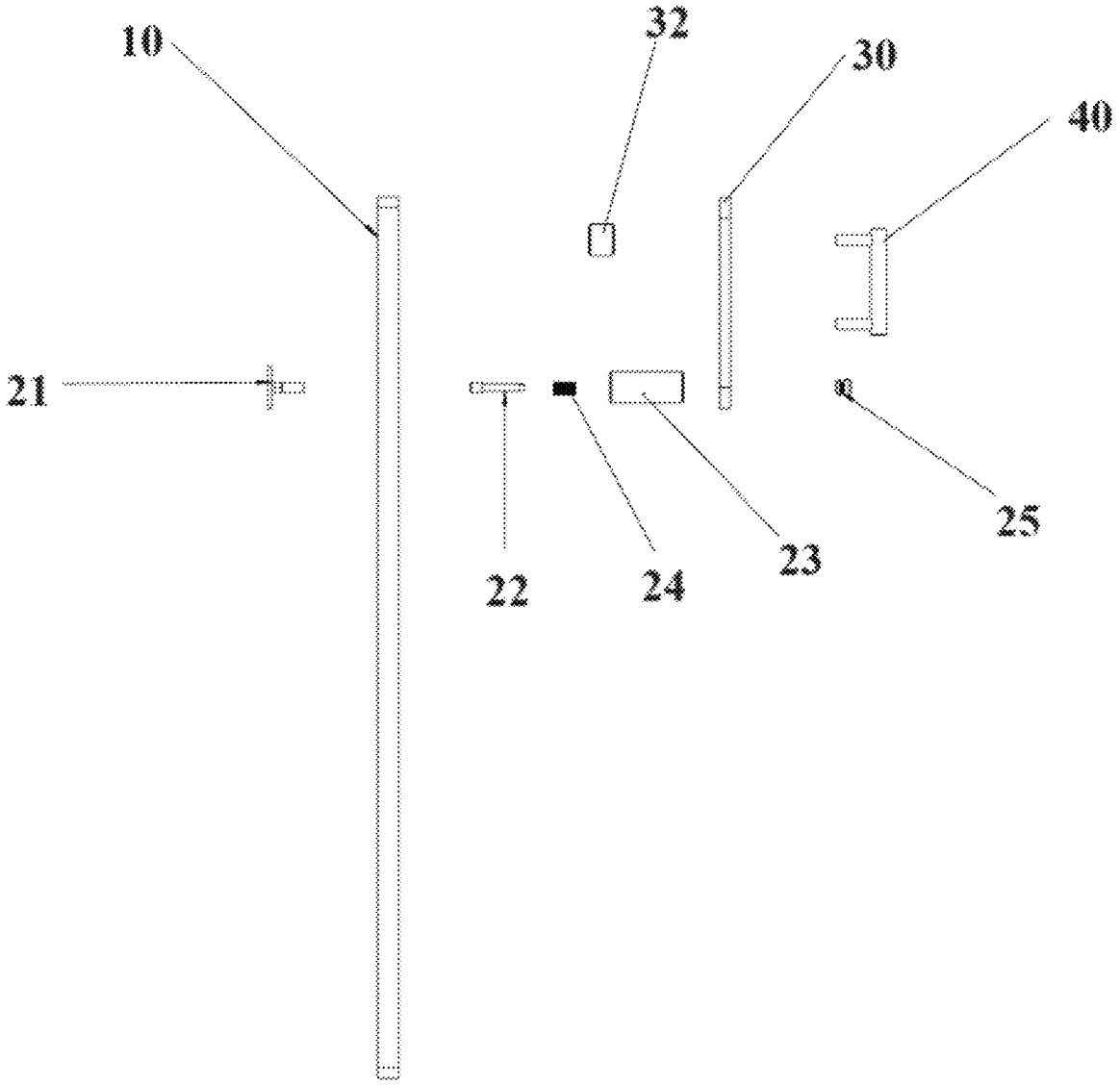
FIG. 1 is a left side view of the present invention.
Figure 2:
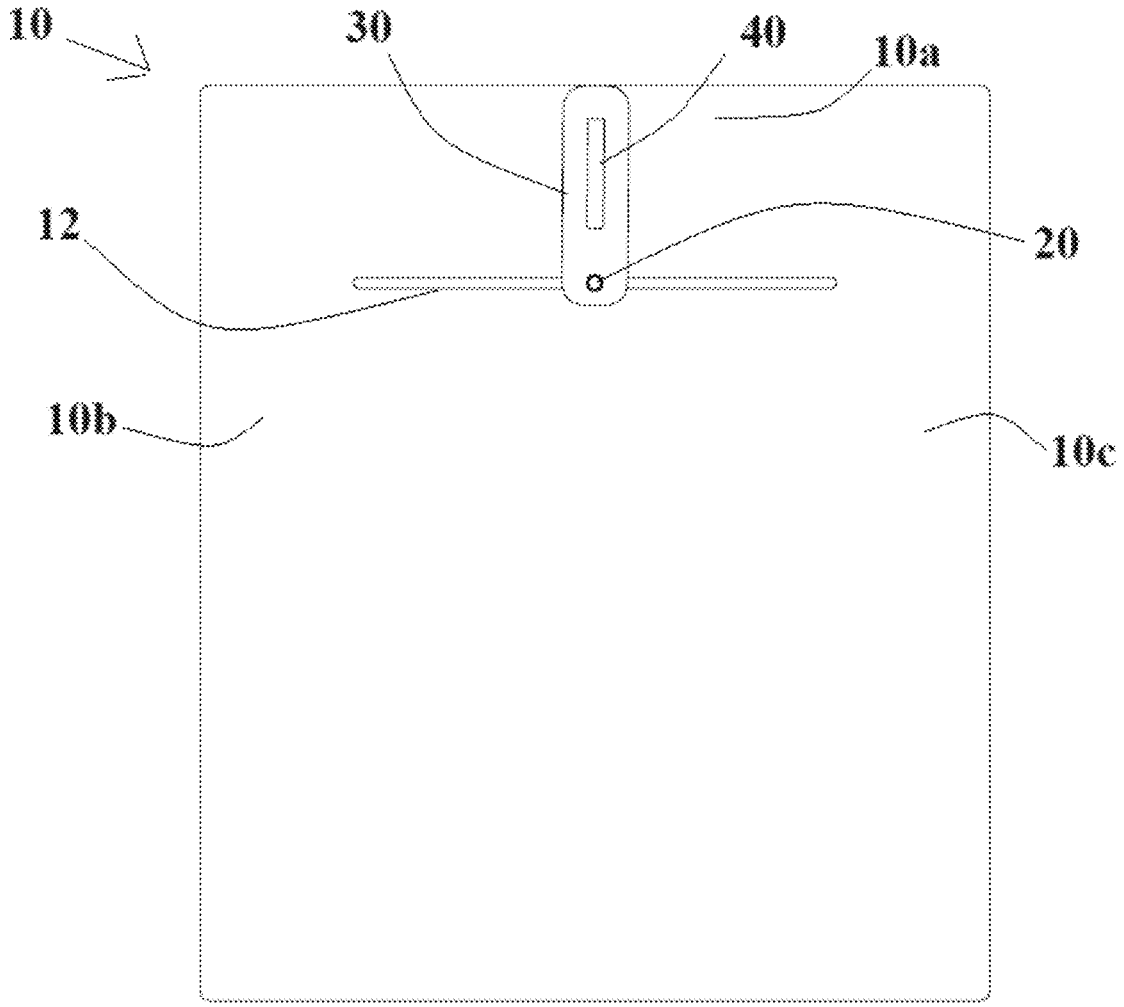
FIG. 2 is a front side view of the present invention.
Figure 3:
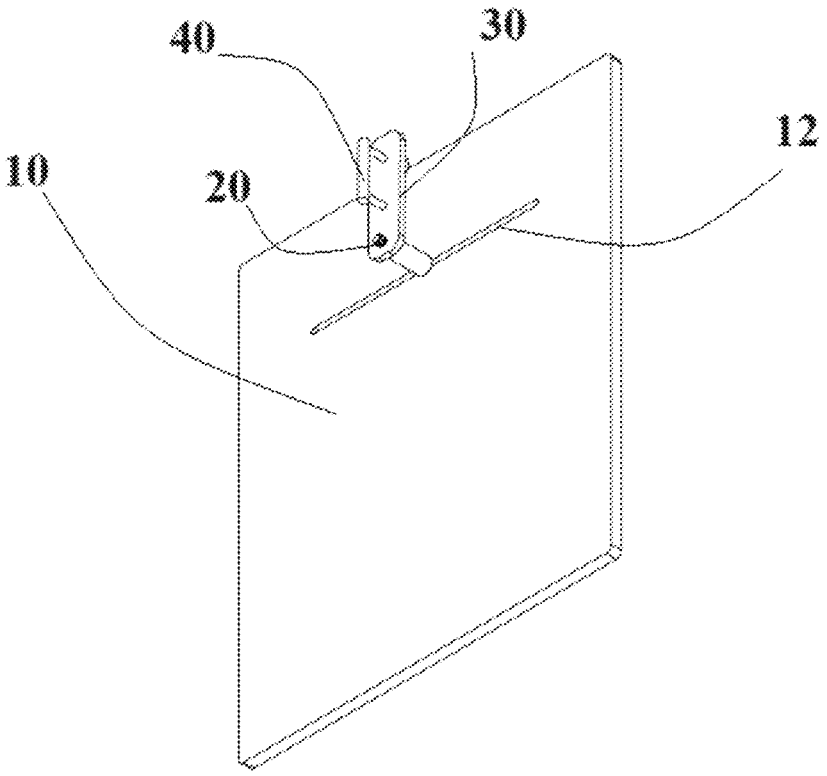
FIG. 3 is a perspective view of the present invention.
Figure 4:
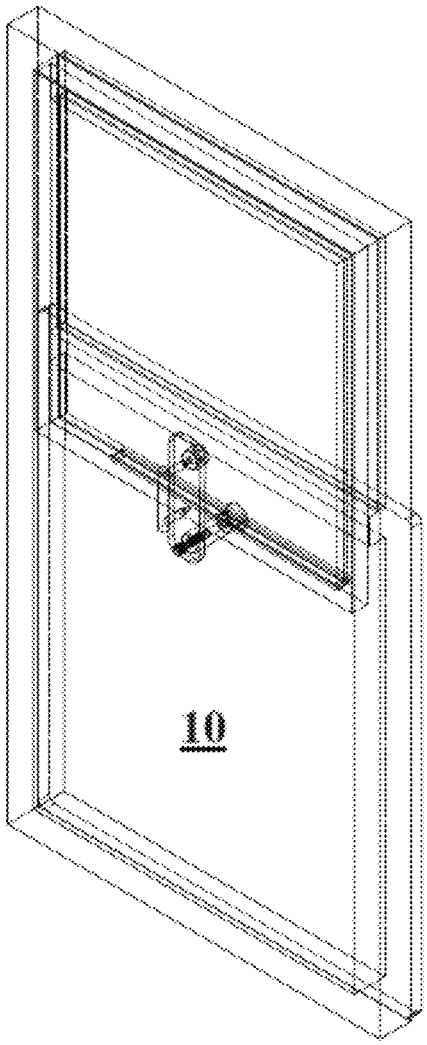
FIG. 4 is a perspective view of the present invention mounted on a window.
Figure 5:
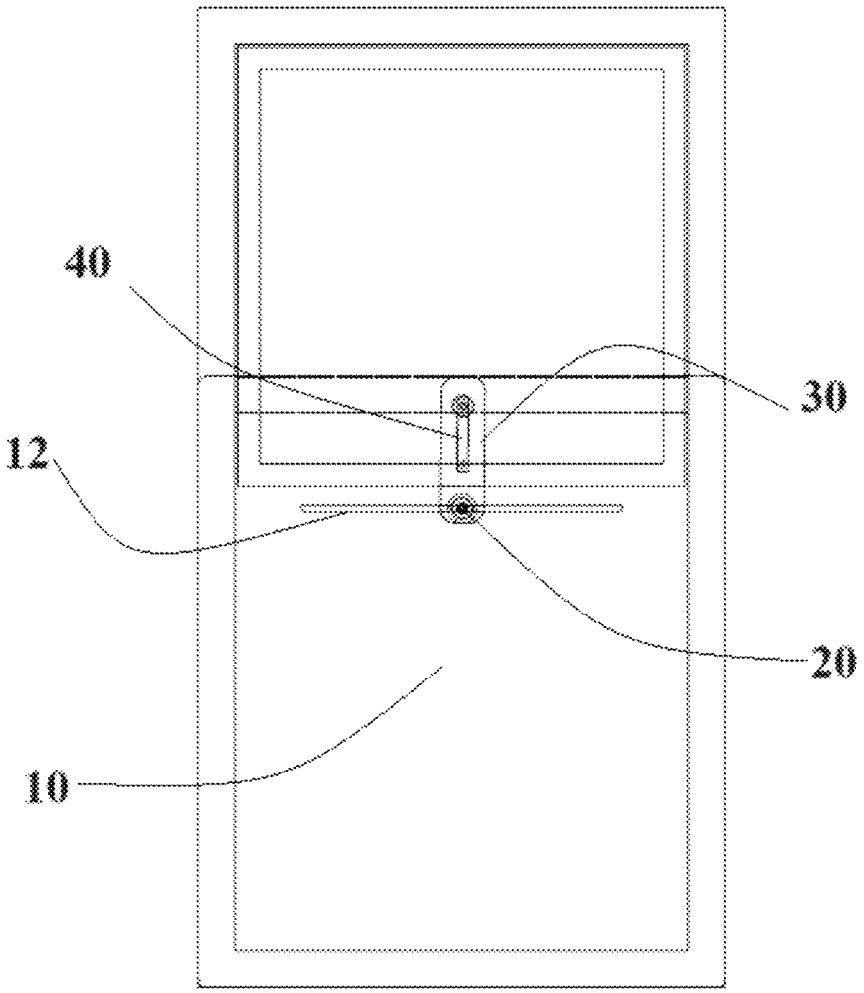
FIG. 5 is a front side view of the present invention secured on a window.

As seen in FIGS. 1-5, the present invention is a safety window cover that is used to install windows that have sashes on window openings.

The safety window cover comprises a rectangular panel 10 that defines a linear slit 12 that runs parallel to a top side 10*a* of the rectangular panel 10, the linear slit 12 is positioned so that each end of the linear slit 12 is equidistant from a left 10*b* and a right side 10*c* of the rectangular panel 10, the rectangular panel 10 has a width of at least 36 inches and a height of at least 39 inches. A pressure pivot mechanism 20 that is mounted onto the linear slit 12, the pressure pivot mechanism 20 is designed to slide on the linear slit 12. And, a lever 30 that if attached to the pressure pivot mechanism 20, the lever 30 is adjacent to a front side of the rectangular panel 10, the lever 30 measures at least 18 inches in length, the lever 30 is designed to lock onto a window frame when a window of the window frame is open, the rectangular panel 10 is placed outside of the window frame during the installation process of the window frame onto a window opening.

In an embodiment of the present invention, a handle 40 is attached to the lever 30.

In a preferred embodiment of the present invention, the linear slit 12 measures between at least 24 inches and at most 30 inches.

In embodiments of the present invention, the rectangular panel 10 is made of a polyvinyl chloride or of a plastic.

In a further embodiment of the present invention, the lever has a rubber stopper 32.

In other embodiments of the present invention, the rectangular panel 10 is made of either an aluminum material or of a stainless-steel material.

In preferred embodiments of the present invention, the pressure pivot mechanism 20 comprises a sliding support 21 that is connected to a piston 22, a spring 24 that is mounted on the piston, a cylinder that that covers the spring, and a nut that locks on to the piston 22 after the lever is secured on the pressure pivot mechanism 20.

An advantage of the present invention is that it provides a safety window cover that allows installers to install window frames in adverse whether conditions.

Another advantage of the present invention is that it provides installers of windows frames with a safety window cover that allows them to secure the window frames onto window openings using industrial drills and drill bits.

The embodiments of the safety window cover herein are exemplary and numerous modifications, combinations, variations, and rearrangements can be readily envisioned to achieve an equivalent result, all of which are intended to be embraced within the scope of the appended claims. Further, nothing in the above-provided discussions of the safety window cover should be construed as limiting the invention to an embodiment or a combination of embodiments. The scope of the invention is defined by the description, drawings, and claims.

What is claimed is:

1. A safety window cover that is used to install windows that have sashes on window openings, the safety window cover comprises:

a rectangular panel that defines a linear slit that runs parallel to a top side of the rectangular panel, the linear slit is positioned so that each end of the linear slit is equidistant from a left and a right side of the rectangular panel, the rectangular panel has a width of at least 36 inches and a height of at least 39 inches;

a pressure pivot mechanism that is mounted onto the linear slit, the pressure pivot mechanism is designed to slide on the linear slit; and a lever that if attached to the pressure pivot, the lever is adjacent to a front side of the rectangular panel, the lever measures at least 18 inches in length, the lever is designed to lock onto a window frame when a window of the window frame is open, the rectangular panel is placed outside of the window frame during the installation process of the window frame onto a window opening.

2. The safety window cover is used to install windows that have sashes on window openings of claim 1, wherein the linear slit measures between at least 24 inches and at most 30 inches.

3. The safety window cover is used to install windows that have sashes on window openings of claim 2, the safety window cover comprises a handle that is attached to the lever.

4. The safety window cover is used to install windows that have sashes on window openings of claim 1, wherein the rectangular panel is made of a polyvinyl chloride or a plastic.

5. The safety window cover is used to install windows that have sashes on window openings of claim 1, wherein the rectangular panel is made of either an aluminum material or a stainless-steel material.

6. The safety window cover is used to install windows that have sashes on window openings of claim 1, wherein the pressure pivot mechanism comprises a sliding support that is connected to a piston, a spring that is mounted on the piston, a cylinder that covers the spring, and a nut that locks on to the piston after the lever is secured on the pressure pivot mechanism.

7. The safety window cover is used to install windows that have sashes on window openings of claim 1, wherein a rubber stopper is attached to the lever.

* * * * *